US011396421B2

(12) United States Patent
Gash et al.

(10) Patent No.: US 11,396,421 B2
(45) Date of Patent: Jul. 26, 2022

(54) INSULATED TANK FOR STORING FLAMMABLE AND COMBUSTIBLE LIQUIDS

(71) Applicant: Western Global Holdings Limited, Bristol (GB)

(72) Inventors: Malcolm Gash, Dubai (AE); David Robinson, Bristol (GB)

(73) Assignee: Western Global Holdings Limited, Bristol (GB)

( * ) Notice: Subject to any disclaimer, the term of this patent is extended or adjusted under 35 U.S.C. 154(b) by 34 days.

(21) Appl. No.: 17/082,123

(22) Filed: Oct. 28, 2020

(65) Prior Publication Data

US 2021/0139234 A1 May 13, 2021

(51) Int. Cl.

| | |
|---|---|
| ***B65D 90/02*** | (2019.01) |
| ***B65D 88/10*** | (2006.01) |
| ***B28B 1/16*** | (2006.01) |
| ***B65D 90/04*** | (2006.01) |
| ***B65D 90/24*** | (2006.01) |

(52) U.S. Cl.

CPC ..... *B65D 90/022* (2013.01); *B28B 1/16* (2013.01); *B65D 88/10* (2013.01); *B65D 90/027* (2013.01); *B65D 90/045* (2013.01); *B65D 90/24* (2013.01)

(58) Field of Classification Search

CPC .... B65D 90/022; B65D 88/10; B65D 90/027; B65D 90/045; B65D 90/24; B65D 90/042; B65D 90/06; B65D 90/02; B65D 90/04; B65D 90/041; B65D 90/044; A62C 3/065; F17C 13/12; F17C 2203/03; F17C 2203/0304; F17C 2203/0341; B28B 1/16

See application file for complete search history.

(56) References Cited

U.S. PATENT DOCUMENTS

| | | | | |
|---|---|---|---|---|
| 4,904,510 | A * | 2/1990 | Nath | E04D 13/16 428/70 |
| 5,256,222 | A * | 10/1993 | Shepherd | C04B 14/185 156/45 |
| 5,540,022 | A * | 7/1996 | Morris | E04D 15/07 52/309.8 |
| 5,601,204 | A * | 2/1997 | Hall | B65D 90/042 220/567.2 |
| 5,809,650 | A * | 9/1998 | Reese | B28B 19/00 29/897.3 |
| D875,206 | S * | 2/2020 | Gourgel | D3/272 |
| 2005/0233656 | A1* | 10/2005 | Royer | D02G 3/447 442/17 |
| 2010/0230418 | A1* | 9/2010 | Rousseau | B65D 88/10 141/1 |
| 2010/0233503 | A1* | 9/2010 | Zachman | B32B 15/012 428/178 |
| 2021/0139234 | A1* | 5/2021 | Gash | B65D 90/06 |

OTHER PUBLICATIONS

UK Search Report for Application No. GB1916457.3 dated Apr. 27, 2020.

* cited by examiner

*Primary Examiner* — Don M Anderson
(74) *Attorney, Agent, or Firm* — Honigman LLP

(57) ABSTRACT

An insulated tank for storing flammable and combustible liquid comprises an outer containment tank and an inner storage tank that defines a reservoir for storing flammable and combustible liquid. The inner storage tank is received within the outer containment tank such that a space is defined between the walls of the inner storage tank and the walls of the outer containment tank. The space contains one or more perlite boards to insulate the inner tank.

16 Claims, 6 Drawing Sheets

INSULATED TANK FOR STORING FLAMMABLE AND COMBUSTIBLE LIQUIDS

CROSS REFERENCE TO RELATED APPLICATION

This U.S. patent application claims priority to Great Britain Application No. GB1916457.3, filed on Nov. 12, 2019. The disclosure of this prior application is considered part of the disclosure of this application and is hereby incorporated by reference in its entirety.

TECHNICAL FIELD

The present application relates to an insulated tank for storing flammable & combustible liquids and a method of manufacturing such a tank.

BACKGROUND

It is known to provide aboveground storage tanks to safely store flammable & combustible liquids such as fuel. For example, large construction sites can consume a significant amount of fuel and having a fuel storage tank on site can remove the time wasted when waiting for fuel deliveries.

The construction and design of aboveground storage tanks may be limited by a number of requirements that must be met to comply with appropriate safety standards. One such standard is known as the Underwriters Laboratory Inc (UL) standard for Protected Above Ground Tanks, also referred to as the UL2085 standard. UL2085 requires an aboveground storage tank to be double walled such that it comprises an inner storage tank for storing flammable & combustible liquid and an outer containment tank within which the inner storage tank is safely contained. To meet this standard, a space defined between the inner storage tank and the outer containment tank typically contains fire and heat resistant insulation that substantially entirely encases the inner storage tank, although vent or pump fixtures or fittings etc. are allowed to extend through the insulation to the inner storage tank from the exterior of the outer containment tank.

Conventionally, the insulation that is used in UL2085-compliant storage tanks is in the form of a concrete aggregate mixture of expanded perlite, cement and water (and in some cases an air entrainment agent). The aggregate mixture is usually pumped into the space between the inner storage tank and the outer containment tank whilst the cement is in an aqueous, liquid state, so that the insulation can readily occupy the entire space, before solidifying and curing to form a concrete aggregate mixture that entirely encases the inner storage tank.

While the ability to be introduced to the space in liquid form makes the concrete aggregate mixture a particularly suitable insulation material for aboveground storage tanks, the mixture accounts for a significantly large proportion of the overall weight of the tanks. Furthermore, storage tanks typically require the thickness of the concrete aggregate mixture to be as much as 15 centimeters (approx. 6 inches) wide in order to provide sufficient insulation to meet the UL2085 standard. This significantly increases the footprint of the tank.

The perlite material in the concrete aggregate mixture is a naturally occurring siliceous volcanic glass mineral which, when expanded, takes on a low density cellular structure that is an effective high-temperature insulation material. Consequently, perlite is often used more widely in a number of fire insulating applications. For example, it is known to use expanded perlite as a component of insulation boards, referred to herein as "perlite boards", which are used in the construction industry as an inlay for fire-proof doors. Perlite boards usually contain a mixture of expanded perlite, fibers and binders that have been formed into a board by a suitable manufacturing process, such as a so-called Fourdrinier process as is known in the art.

It is desired to provide an improved aboveground insulated storage tank for storing flammable & combustible liquids and a method of manufacturing such a tank.

SUMMARY

According to an aspect, there is provided an insulated tank for storing flammable & combustible liquid, comprising: an outer containment tank; and an inner storage tank that defines a reservoir for storing combustible liquid; wherein the inner storage tank is received within the outer containment tank such that a space is defined between the walls of the inner storage tank and the walls of the outer containment tank; and wherein the space contains one or more perlite boards to insulate the inner tank.

Although perlite boards are known in the art, their use as insulation in aboveground storage tanks of the type described herein is considered to be both novel and inventive in its own right. Commercially available perlite boards have a lower density and thermal conductivity than conventional concrete aggregate mixtures. Accordingly, their inclusion in the space defined between the inner storage tank and the outer containment tank, which may be in addition to or a wholesale replacement of the conventional concrete aggregate mixture, allows one to realize the same levels of heat and fire resistance as that achieved by using only a concrete aggregate mixture, but with a lower volume and weight of insulation material. This may be advantageous in that it can reduce the footprint and weight of the overall storage tank, for the same liquid storage capacity.

Further, providing an arrangement in line with the technology described herein, goes against a long-held industry practice whereby a concrete aggregate mixture has been used as the only insulating material for aboveground storage tanks, partly due to its suitability to entirely fill the space defined between the inner and outer tanks (and thereby entirely encase the inner tank) when in its liquid aqueous form, e.g. during manufacture.

The inner storage tank may be supported within the outer containment tank by at least one perlite board that is positioned on a base wall of the outer containment tank. This is in contrast to hypothetical storage tanks in which metal spacers are used to support the walls of the inner storage tank away from those of the outer containment tank, to allow the aqueous concrete aggregate mixture to be poured into the space during manufacture. Indeed, by supporting the inner storage tank on one or more perlite boards, the need for such spacers, which may act as heat paths from the outer containment tank to the inner storage tank, is obviated. This may advantageously reduce the transmission of heat from the walls of the outer containment tank to the walls of the inner storage tank in the event of exposure to fire, and thus the risk of igniting the flammable or combustible liquid contained therein.

The space may further contain a concrete aggregate mixture of cement and perlite. This may increase the strength and structural integrity of the storage tank. This may be particularly advantageous in that it could enable the storage tank to meet another requirement of the UL2085 standard, which is that the inner tank must be able to withstand a predetermined impact force.

The outer containment tank may comprise a stiffening arm that extends inwards by a perpendicular extent from an inner surface of a wall of the outer containment tank. The perpendicular extent may be larger than a thickness of the one or more perlite boards, such that a distal end of the stiffening arm to the inner surface protrudes into the concrete aggregate mixture. This may further increase the strength and structural integrity of the storage tank.

The stiffening arm may have at least one slot that is filled by the concrete aggregate mixture. This may anchor the stiffening arm to the concrete aggregate mixture and increase the rigidity of the storage tank.

A wall of the inner storage tank may have a corrugated structure. This may further increase the strength and structural integrity of the inner storage tank.

The distal end of the stiffening arm may be received in a space that is within an indentation of the corrugated structure of the wall of the inner storage tank. As will be described in further detail below, this may increase the storage capacity of the inner storage tank whilst ensuring that a given strength of the overall storage tank is maintained.

The outer containment tank may be in the form that it can easily be transported by an intermodal shipping container, e.g. that is compliant with the ISO shipping container standards (such as ISO 6346, as is known in the art). In particular, the outer containment tank may be shaped to define a substantially, e.g. rectangular, cuboidal structure. Such arrangements may be advantageous in that they allow the aboveground storage tanks to be easily relocated and shipped internationally.

According to a further aspect, there is provided a method of manufacturing an insulated tank for storing flammable & combustible liquid, comprising: forming a first tank (e.g. the inner storage tank) that defines a reservoir for storing combustible liquid; forming a second tank (e.g. the outer containment tank) that has an open end suitable for receiving the first tank therethrough; lining an inner surface of the second tank or an outer surface of the first tank with one or more perlite boards; inserting the first tank into the second tank through the open end of the second tank; and connecting an open end wall to the second tank so as to substantially close the open end of the second tank.

The method may further comprise the step of forming the first tank to have one or more corrugated walls.

The step of inserting the first tank into the second tank through the open end of the second tank may begin after the step of lining an inner surface of the second tank or an outer surface of the first tank with one or more perlite boards has been completed. This is in contrast to hypothetical methods in which insulation material is installed only after the first tank is placed inside the second tank.

The method may comprise the step of lining an inner surface of a base wall of the second tank with one or more perlite boards. The method may comprise the step of positioning the first tank on the one or more perlite boards that line the inner surface of the base wall of the second tank, such that the first tank is supported within the second tank by the one or more perlite boards.

The method may comprise the step of, after connecting an open end wall to the second tank so as to substantially close the open end of the second tank: inserting an aqueous mixture of cement and perlite into a space between the first and second tank. The aqueous mixture of cement and perlite may be allowed to harden and cure to form a concrete aggregate mixture of cement and perlite. The inclusion of the concrete aggregate mixture, in an aqueous form, may enable the space defined between the walls of the first tank and the second tank (including the one or more perlite boards) to be more easily and effectively filled, as compared to arrangements in which only perlite boards are used.

The step of forming a second tank may comprise affixing a stiffening arm to the inner surface of the second tank, the stiffening arm extending inwards by a perpendicular extent from an inner surface of a wall of the second tank that is larger than a thickness of the one or more perlite boards.

A distal end of the stiffening arm from the inner surface of the second tank may be received in a space that is within an indentation of the one or more corrugated walls of the first tank.

The stiffening arm may have one or more slots through which a flow of the aqueous mixture of cement and perlite is received when inserting an aqueous mixture of cement and perlite into a space between the first and second tank. The provision of such slots may facilitate the flow of aqueous concrete aggregate mixture through the space, which may result in a more evenly distributed concrete aggregate mixture and enhanced insulation properties.

BRIEF DESCRIPTION OF THE DRAWINGS

Embodiments of the technology described herein will now be described by way of example only, with reference to the drawings, in which.

It will be appreciated that like reference numerals are used in the drawings, where applicable, to label like features of the technology described herein.

DETAILED DESCRIPTION

Figure 1:
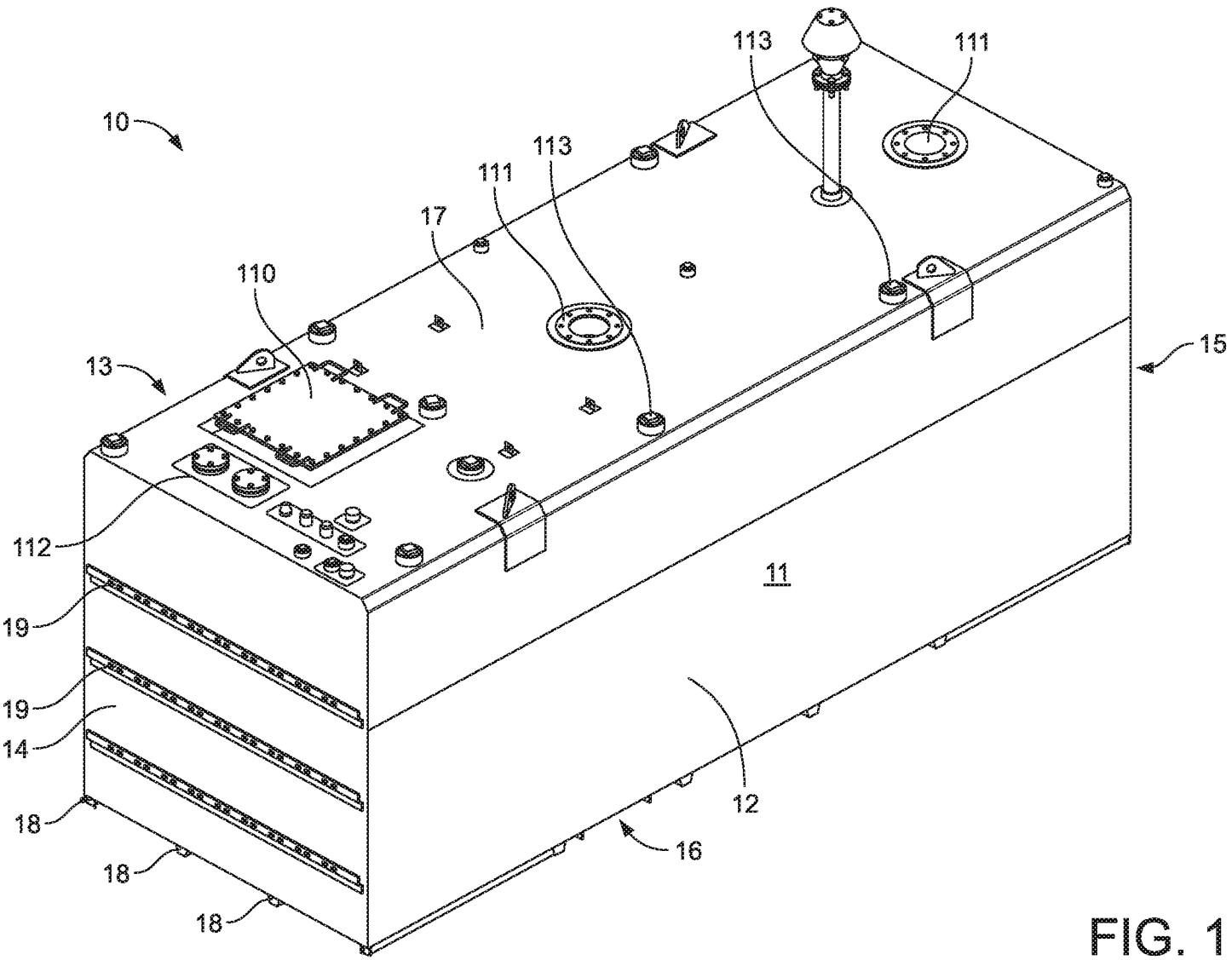
FIG. 1 is a perspective view of an aboveground double walled storage tank for storing fuel, according to an embodiment of the technology described herein.
Figure 2:
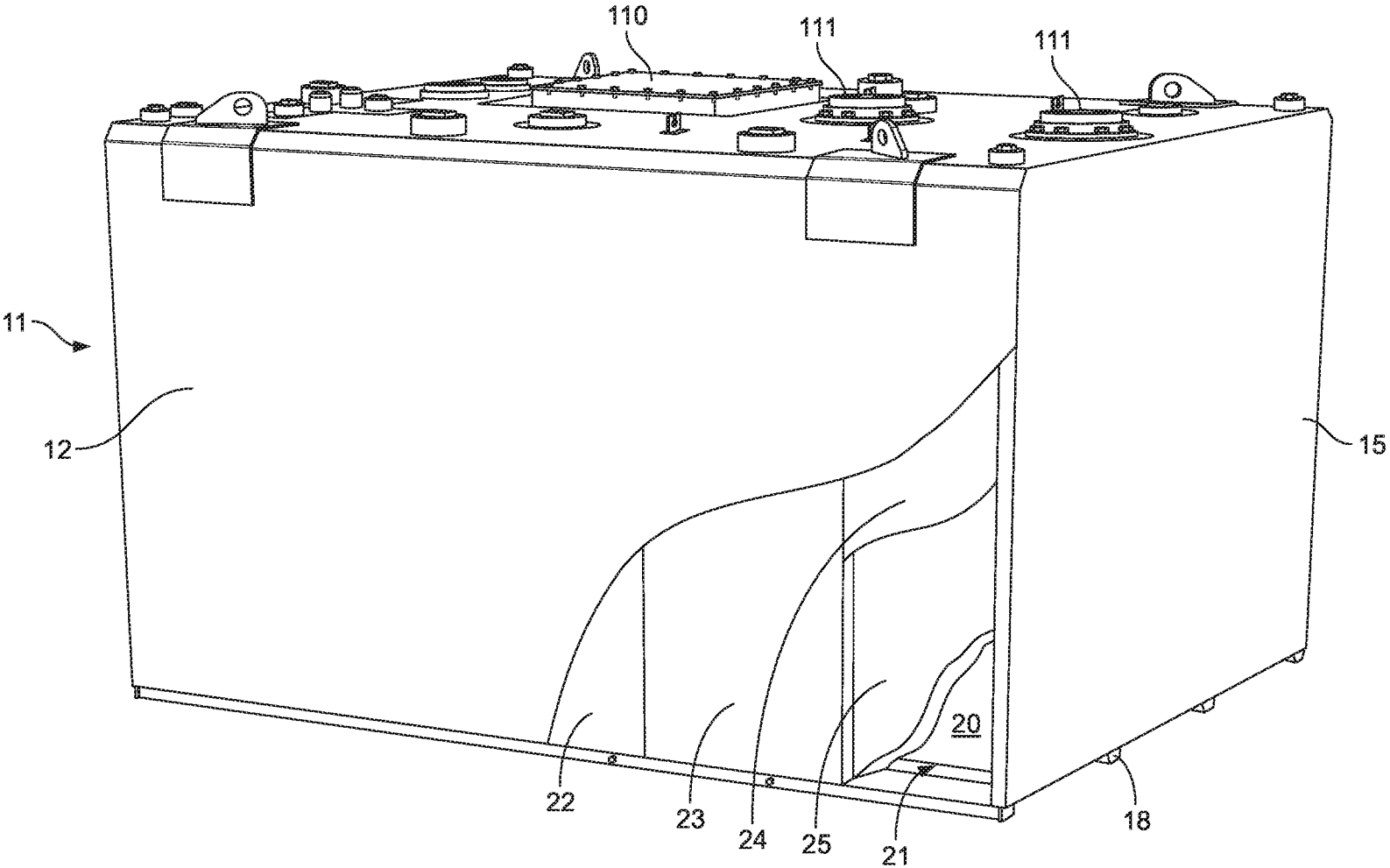
FIG. 2 is a cutaway perspective view of the double walled storage tank of FIG. 1, having a portion of a side wall of the outer containment tank removed to reveal its double walled structure, in particular the space defined between the outer containment tank and the inner storage tank.

FIG. 1 is a perspective view of an aboveground insulated storage tank 10 for storing fuel, according to an embodiment of the technology described herein.

The storage tank 10 comprises an outer containment tank 11 within which the inner storage tank and fuel reservoir (not shown) is contained. The outer containment tank 11 is positioned horizontally, when in use, and has side walls 12 and 13, a front wall 14, rear wall 15, a base wall 16 and a top wall 17. The walls of the storage tank 10 are manufactured from steel, such as carbon steel, and are welded together using suitable methods known in the art.

The overall weight of the tank 10 is supported by a plurality of feet 18 that extend along the base wall 16. The feet may be arranged in any suitable manner for supporting the weight of the storage tank 10. On the front wall 14 of the storage tank 10, there is provided a plurality of attachment points 19, onto which a pumping assembly (not shown) may be attached, for example, to pump fuel from the reservoir within the inner storage tank.

The top wall 17 of the outer containment tank 11 has a set of conventional fixtures and fittings (only some of which are labelled in the drawings, for simplicity). Many of those fixtures and fittings connect the exterior of the storage tank 10 to the interior of the inner storage tank, such as a manhole 110 for allowing inspection of the inner storage tank, emergency vent openings 111 and pipe fittings 112 for connecting to the pump assembly. Other fixtures and fittings connect the exterior of the storage tank 10 to a space defined between the outer containment tank 11 and the inner storage tank. In particular, the top wall 17 has a plurality of fittings 113 that allow insulation material to be provided to the space defined between the outer containment tank 11 and the inner storage tank.

It will be appreciated that the storage tank 10 can have any number and type of fixtures and fittings, as may be desirable for the manufacture and use of the storage tank 10. The particular arrangement shown and described with respect to the drawings is provided as an example only, and in practice the arrangement may vary on a tank-by-tank basis depending on the particular application in question.

With reference to FIGS. 2 to 5, and as mentioned above, the aboveground storage tank 10 includes an inner storage tank 20 that is received entirely within and is enclosed by the walls of the outer containment tank 11. The interior surfaces of the walls of the inner storage tank 20 define a reservoir in which a combustible liquid is to be stored. Although not shown, the inner storage tank 20 may be substantially the same shape as that of the outer containment tank 11, in that it has side walls, a front wall, a rear wall, a base wall and a top wall that are welded together using conventional techniques. The side walls, a front wall, a rear wall, a base wall and a top wall of the inner storage tank 20 may be substantially parallel to the side walls 12 and 13, a front wall 14, rear wall 15, a base wall 16 and a top wall 17 of the outer containment tank 11, respectively. As mentioned above, the walls may be formed of steel, e.g. carbon steel.

The inner storage tank 20 is positioned within the outer containment tank 11 such that they are concentric but spaced apart from each other. In particular, the walls of the inner storage tank 20 and the walls of the outer containment tank 11 are spaced apart such that their walls do not directly contact each other at any point, but instead define a space 21 therebetween. The distance separating the inner storage tank 20 and the outer containment tank 11, or rather the thickness of the space 21, may be less than 15 centimeters (approx. 6 inches) wide, e.g. 10 centimeters wide.

Figure 3:
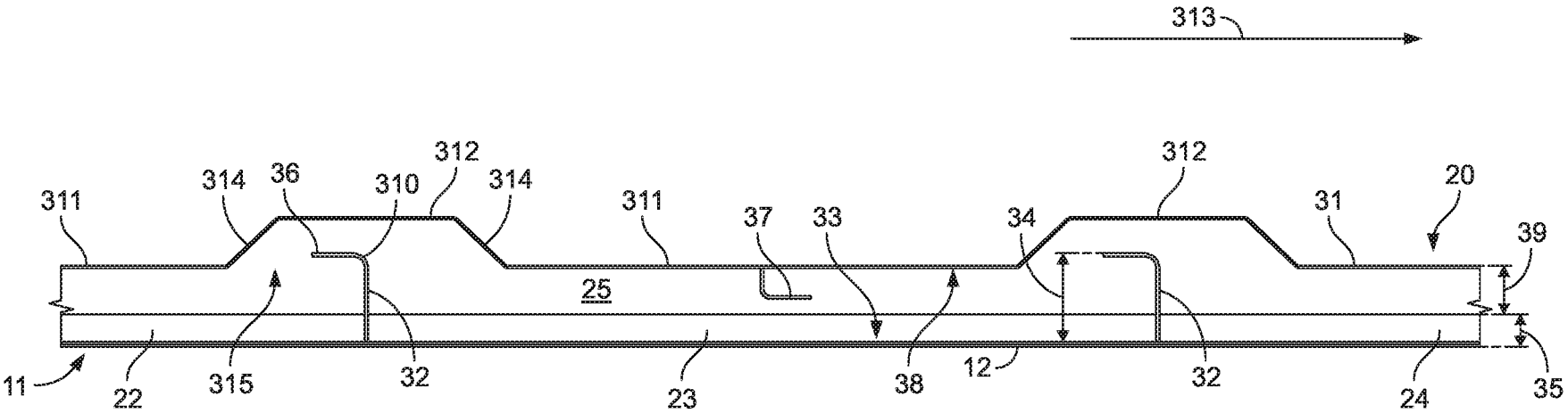
FIG. 3 is a cross-sectional, top view of a section of the double walled structure on one side of the storage tank of FIGS. 1 and 2.
Figure 5:
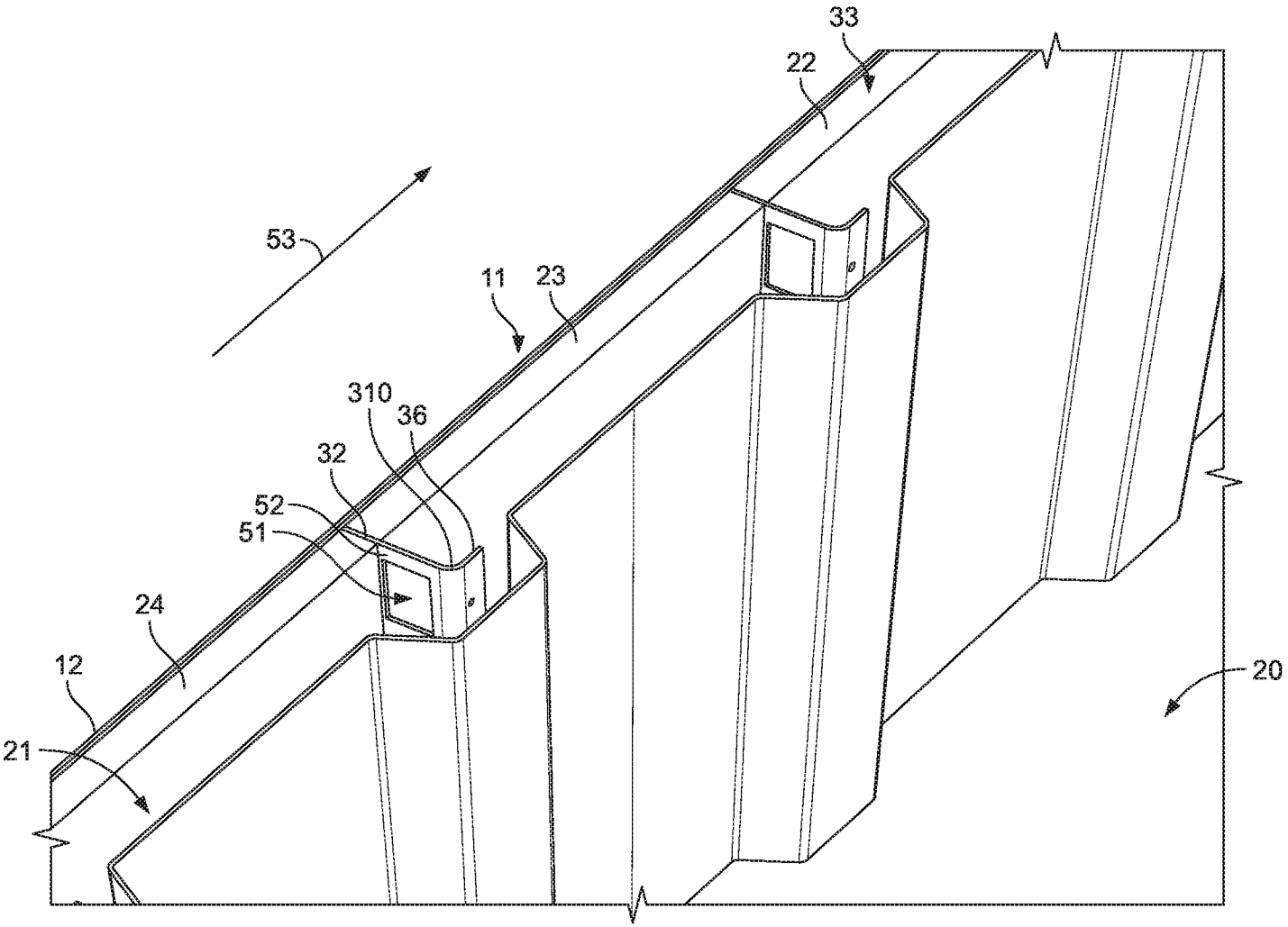
FIG. 5 is a perspective view of the double walled structure of the storage tank.

The space 21 contains heat and flame resistant insulation that substantially entirely encases the inner storage tank, save for any fixtures or fitting that extend from the exterior of the outer containment tank 11 through the insulation to the inner storage tank 20. As best shown in FIGS. 3 and 5, an inwardly facing surface 33 of the outer side wall 12 of the outer containment tank 11 is lined with a first perlite board 22, a second perlite board 23 and a third perlite board 24, each of which has a length that extends in substantially the vertical direction of the storage tank 10.

It will be appreciated here that although three perlite boards are shown to line the inner surface of the outer side wall 12, in practice there may be more or less perlite boards as may be necessary and appropriate for lining the inner surface of the outer side wall 12, e.g. depending on the relative surface areas of the perlite boards and inner side wall 12. Furthermore, it will be appreciated that any one or more walls of the outer containment tank may have its inner surface lined with one or more perlite boards. Indeed, in embodiments the inner surfaces of all of the walls of the outer containment tank may be lined with one or more perlite boards. In other arrangements, however, the inner surface(s) of some but not all of the walls of the outer containment tank 12 are lined with at least one perlite board.

The perlite boards 22, 23 and 24 are held in place by a first set of stiffening arms 32 that are welded to the inner surfaces of the outer tank walls, particularly side wall 12. The stiffening arms 32 extend substantially perpendicularly from the inwardly facing surface 33 of the side wall 12 to which they are attached, along substantially the entire length of the perlite boards 22, 23, 24 (corresponding to the vertical direction of the aboveground storage tank). In order to hold the perlite boards securely, neighbouring pairs of stiffening arms 32 in the horizontal direction along the side wall 12 of the tank are spaced from each other at a pitch that is substantially equal to the width of the perlite boards 22, 23, 24, so that a perlite board 22, 23, 24 is snugly received in the space defined therebetween.

Figure 4:
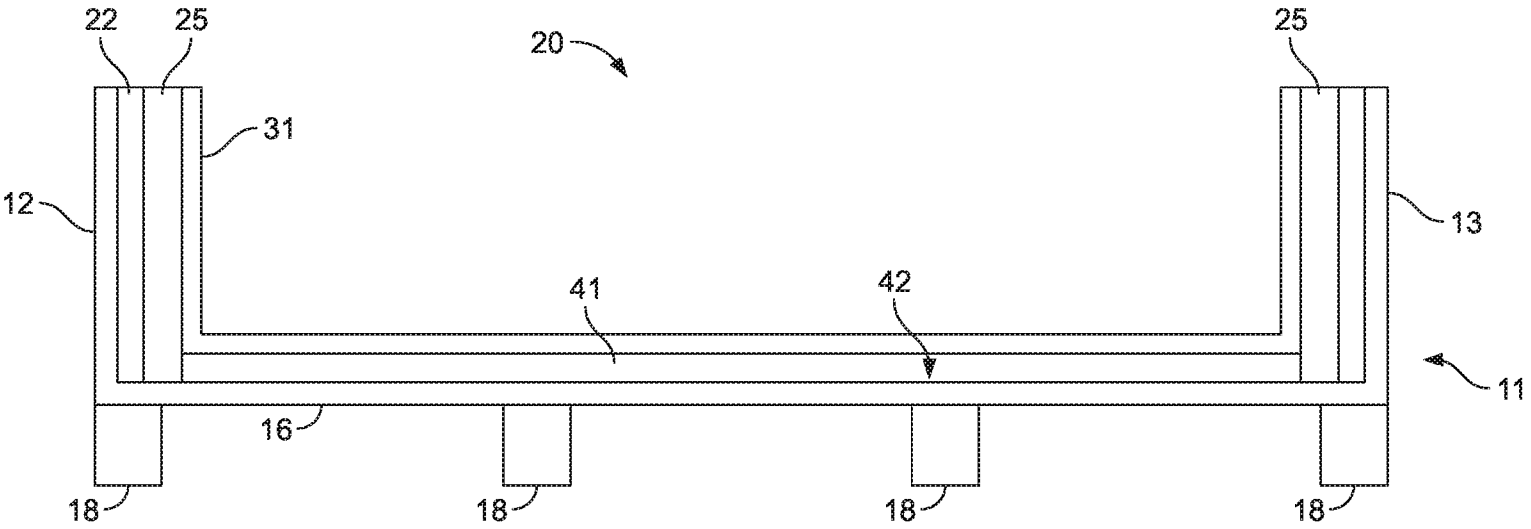
FIG. 4 is a cross-sectional front view of a bottom section of the storage tank, in accordance with an embodiment of the technology described herein.

As best shown in FIG. 4, the inner storage tank 20 is directly supported by a perlite board 41 that is positioned on an interior surface 42 of the base wall 16 of the outer containment tank 11. In other embodiments, there may be two or more layers of perlite boards stacked or otherwise secured on top of each other and positioned on an interior surface 42 of the base wall 16 of the outer containment tank 11, so as to support the inner storage tank 20. This is in contrast to hypothetical arrangements in which the inner storage tank 20 must be supported by one or more (e.g. metal) spacers that are connected to the base wall 16, to allow for the concrete aggregate mixture to flow below the inner storage tank during manufacture. By supporting the inner storage tank 20 with one or more perlite boards (e.g. only), the inner storage tank 20 may be held in position without the need for such spacers that would transfer heat from the outer containment tank 11 to the inner storage tank 20 in the event of an external fire. Thus the technology described herein may reduce the number of heat conducting paths between the two tanks.

The perlite boards are monolithic, rigid panels of material that includes expanded perlite, reinforcing fibers and a binder material. The expanded perlite may be milled or unmilled and may account for 60-95 percent by weight of the board. Glass fiber, mineral wool, nylon cord, and other such materials may be used as the reinforcing fibers. The binder may be any suitable material or agent that holds together the expanded perlite and fibers. As is known in the art, the binder may be an acrylic polymer or a polymer resin and combinations thereof. Fire retardants may also form part of the material of the perlite boards. A number of methods for manufacturing such boards are known in the art, and generally include the steps of forming the material mixture, drying or curing the mixture and then fabricating the cured mixture into boards. One example of a suitable manufacturing process known in the art is the so-called Fourdrinier process.

An example of a perlite board that is suitable for use in the technology described herein is the so-called "Batiboard 200+", which may be purchased by Sitek Insulation Sasu. The material specification of this perlite board is as follows:

Nominal density: 270 kg/m$^3$

Thickness: 25-50 mm

Thermal conductivity: 0.060 W/milliKelvin

Nominal compression stress at yield point: 150 kPa

Tensile strength perpendicular to faces of the board: 60 kPa

Such a perlite board offer lightness, stiffness, durability and good resistance to fire and heat load, as compared to the conventional insulation in which only a concrete aggregate mixture is used. For example, the conventional concrete aggregate mixture that is suitable for meeting the requirements of the UL2085 standard has a nominal dry density of approximately 350 kg/m3 and a thermal conductivity of approximately 0.075 W/mK. Accordingly, the provision of perlite boards in the space 21 defined between the inner storage tank 20 and the outer containment tank 11 allows one to realize the same levels of heat and fire resistance as that achieved by using only a concrete aggregate mixture, but with a lower volume and weight of insulation material. This may be advantageous in that it can reduce the footprint and weight of the overall storage tank, for the same liquid storage capacity. Perlite boards are also porous, which allows vapors to escape to vents to prevent a dangerous build-up of pressure in the space between the tanks.

The perlite boards may be used as a wholesale replacement of the conventional concrete aggregate mixture, and in that regard the perlite boards may also line the outer surfaces of the inner storage tank 20 and fill substantially the entire space 21 defined between the inner storage tank 20 and the outer containment tank 11 (save for the fixtures, fittings and stiffening arms 32 described above, for example). However, in the illustrated embodiment, the perlite boards fill some but not all of the space 21, so as to define a void between the inward facing surfaces of the perlite boards and the outer surfaces of the inner storage tank 20, which is filled substantially entirely with a concrete aggregate mixture 25 of expanded perlite, type 1 cement and water (and optionally an air entrainment agent). The space 21 may be generally 10 centimeters wide and filled by 4 centimeter wide board(s) and 6 centimeter wide concrete aggregate mixture.

The concrete aggregate mixture 25 may be any suitable mixture of expanded perlite, cement, water and an air entrainment agent that is suitable for meeting the requirements of the UL2085 standard. In an embodiment, a suitable ratio of cement to expanded perlite to water to air entrainment agent by weight is 0.3622:0.1545:0.4830:0.0003. Another suitable ratio of cement to expanded perlite to water to air entrainment agent by volume may be 1:8:2:0.03.

As best shown in FIG. 3, each stiffening arm 32 extends from the inner surface of the outer tank wall 12 to which it is attached by a perpendicular extent 34 that is greater than the width 35 of the perlite boards 22, 23, 24 (in the normal direction to the inner surface 33), such that a distal end 36 of the stiffening arm 32 from the outer tank wall 12 is positioned within the concrete aggregate mixture 25. In this way, the stiffening arms 32 serve not only to hold the perlite boards in place, but also to increase the stiffenes and hence the structural integrity of the overall storage tank 10. This may allow the amount of concrete aggregate mixture to be reduced, as compared to the amount of concrete aggregate mixture that would otherwise be required to provide the same structural integrity. This further reduces the weight and footprint of the overall storage tank 10.

Each one of the first set of stiffening arms 32 has a substantially L-shape in cross-section (when taken along the transvere direction), where a corner section 310 of the L-shape is at the distal end 36 of the stiffening arm 32. In other arrangements, however, each stiffening arm may instead have a substantially T-shape in cross-section, where the corner sections of the T-shape are at the distal end of the stiffening arm. These shapes serve to anchor the stiffening arms 32 to the concrete aggregate mixture 25, thereby increasing the rigidity of the double walled structure.

As best shown in FIG. 5, which illustrates the double walled structure without the concrete aggregate mixture, the first set of stiffening arms 32 have slots or holes 51 extending through planar surfaces 52 of respective stiffening arms 32 with which the perlite boards 23 and 24 abut. The holes 51 extend in the horizontal direction 53, to aid the flow of perlite and concrete mixture around the space 21 when poured or pumped into the space 21 in its aqueous form.

With reference again to FIG. 3, the inner storage tank 20 includes a second set of stiffening arms 37 extending from the outer surface 38 of a side wall 31 of the inner storage tank 20, although only one such stiffening arm 37 is shown in FIG. 3. The second set of stiffening arms 37 have substantially the same structure as that of the first set of stiffening arms 32 in that each arm 37 is substantially L-shaped or T-shaped in cross-section, where the corner section(s) of the L-shape or T-shape is at the distal end 36 of the stiffening arm 37 away from the outer surface 38 of the inner storage tank 20 to which it is attached (welded). The second set of stiffening arms 37 extend by a perpendicular extent 39 from the outer surface 38 of the inner storage tank that is less than the thickness of the concrete aggregate mixture 25, to ensure that the distal ends 36 of the stiffening arms 37 are located within the concrete aggregate mixture 25.

The first and second sets of stiffening arms 32, 37 have perpendicular extents 34, 39 that are less than the width of the space 21 between the inner storage tank 20 and the outer containment tank 11 in that region, when measured along the same perpendicular direction. This ensures that the stiffening arms 32, 37 do not connect the inner storage tank 20 and the outer containment tank 11 and present a heat path from the exterior of the storage tank 10 and the combustible liquid to be stored in the inner storage tank 20.

The inner storage tank walls are each in the form of sheet metal that has been folded and shaped to define a substantially corrugated structure in the horizontal direction. Such a corrugated structure may serve to increase the rigidity of the walls of the inner tank 20 and therefore the structural integrity of the storage tank 10.

As best shown with respect to the inner tank side wall 31 of FIG. 3, the corrugation is in the form of a plurality of alternating peak sections 311 and trough sections 312 extending in a corrugation direction 313, corresponding to the horizontal direction of the storage tank 10. The peak sections 311 are connected to their associated trough sections 312 by angled surfaces 314. The plurality of alternating peak sections 311 and trough sections 312 form a series of indentations or depressions 315 on the outer surface 38 of the inner storage tank wall 31.

The indentations or depressions 315 on the outer surface 38 of the inner storage tank wall 31 are aligned with respective ones of the first set of stiffening arms 32 along the direction of corrugation 313. In particular, the center of a given indentation or depression 315 on the outer surface of inner storage tank wall 31 is at the same position as a stiffening arm 32 along the direction of corrugation 313. The distal end 36 of a respective stiffening arm 32 is received within a corresponding indentation or depression 315. That is, a distal end 36 of a stiffening arm 32 is positioned between the two angled surfaces 314 of a given indentation or depression 315 in the direction of corrugation 313.

In this regard, in some cases, in order to provide sufficient strength to meet the UL2085 standards for impact resistance, the perpendicular extent of the first set of stiffening arms 32 may have to be of a length that is greater than the thickness of the total insulation (i.e. both perlite boards and concrete aggregate mixture) that is required to satisfy the flame and heat resistance requirements of the UL2085 standard. However, by providing a corrugated inner tank structure, where the distal ends 36 of the stiffening arms 32 are positioned within respective indentation or depression 315 of the corrugation, the storage capacity of the inner storage tank may be maximized in regions between adjacent stiffening arms 32, whilst ensuring that the structural integrity of the tank is sufficiently high to meet the impact resistance requirements.

Figure 6:
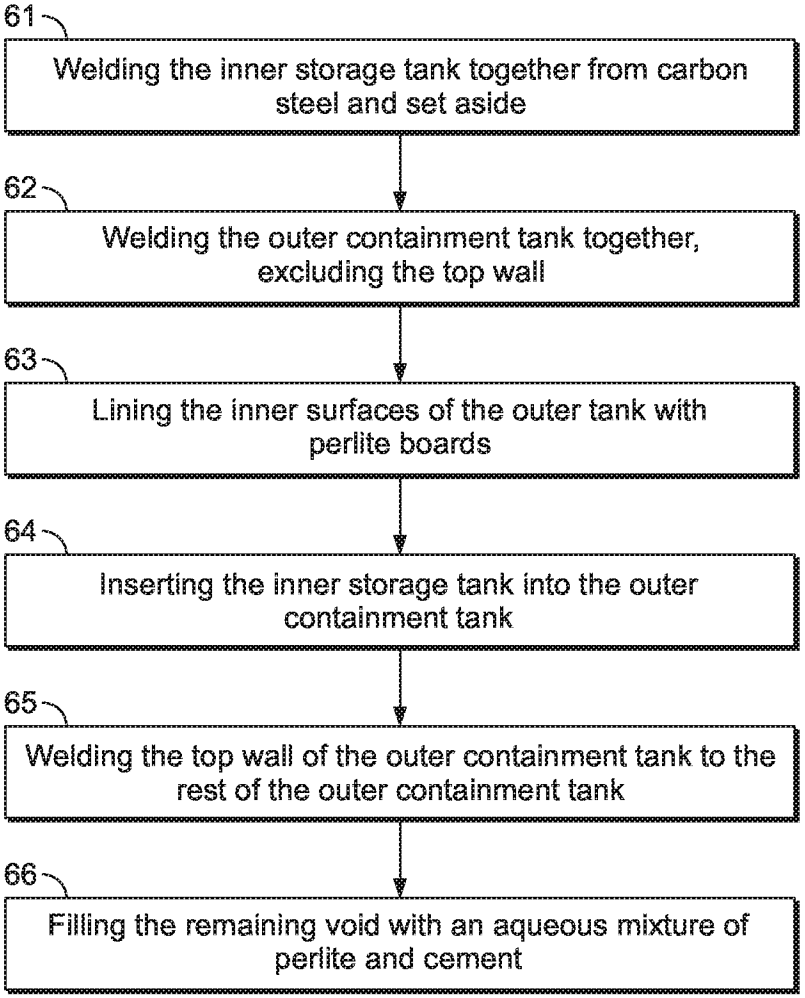
FIG. 6 is a flow chart illustrating the manufacturing steps carried out when forming the insulated storage tank, in accordance with an embodiment of the technology described herein.

FIG. 6 is a flow chart illustrating the manufacturing steps carried out when constructing the insulated storage tank, in accordance with an embodiment of the technology described herein.

The method begins at step 61, at which the inner storage tank is formed by welding its walls together using carbon steel. One or more or all of the walls, particularly the side, front and rear walls of the inner storage tank may have been pressed or otherwise shaped, at a preceding stage, into a corrugated structure as described above. The walls of the inner storage tank are formed to substantially entirely enclose an interior space that defines a reservoir for storing combustible liquid.

At step 62, the outer containment tank is formed by welding the front, rear, side and bottom walls together. Again, the walls may be formed of carbon steel. The outer containment tank is manufactured without the top wall at this stage, so that the outer containment tank has an open end at the top of the tank for receiving the first tank therethrough. Instead, the top wall and its associated fixtures and fittings, is manufacture and kept separately to the rest outer containment tank. At step 62, the method may include the step of affixing the first set of stiffening arms to the inner surface of the second tank, by welding. Further, one or more slots may be cut through the stiffening arms using any suitable technique known in the art.

At this point, the method proceeds to step 63, at which the inner surfaces of the outer containment tank are lined with perlite boards. It will be appreciated that any one or more or all of the interior surfaces of the outer containment tank may be lined with perlite boards. For example, as described above, only the base, side, front and rear walls of the outer containment tank may be lined with perlite boards. In other embodiments, the top wall is also lined with one or more perlite boards.

After lining an inner surface of the outer containment tank with one or more perlite boards, the inner storage tank is inserted, at step 64, into the outer containment tank through the open end at the top of the outer containment tank, such that the the inner storage tank is supported entirely by the perlite board(s) lining the base wall of the outer containment tank. The inner storage tank is supported and received within the outer containment tank such that a space is defined between the walls of the inner storage tank and the walls of the outer containment tank around the entire profile of the inner storage tank.

When the inner storage tank is in place within the outer containment tank, the roof of the outer containment tank is welded to the outer containment tank at step 65, so as to substantially close the open end of the outer containment tank. In this configuration the outer containment tank substantially entirely encloses the inner storage tank (save for any venting or piping that connect the inner storage tank to the exterior of the overall tank, as may be required). Optionally, at this stage the outer containment tank is pressure tested to ensure it is air tight.

At step 66, after closing the open end of the the outer containment tank, an aqueous mixture of cement and perlite is pumped or otherwise introduced into the remaining void or space defined between the walls of the inner storage tank and the walls of the outer containment tank (or rather the inwardly facing surface of the perlite boards that line the interior of outer containment tank). The aqueous mixture of cement and perlite is then allowed to harden and cure to form a concrete aggregate mixture of cement and perlite. As mentioned above, the aqueous mixture of cement and perlite may fill the space between the outer containment tank and the inner storage tank substantially completely.

It will be appreciated that due to the presence of the perlite boards, a relatively small quantity of cement and perlite mixture is required to fill the remaining void in order to achieve a desired insulating property, as compared to the quantity of cement and perlite mixture that would otherwise be required in the absence of perlite boards, thereby reducing the weight and volume of the insulation.

It will be appreciated that the order of carrying out the above manufacturing steps may differ from that by which they are presented above. For example, steps 61 and 62 may be done concurrently, or step 62 (and also step 63) may be carried out in advance of step 61.

In the manner described above, the technology described herein provides an aboveground insulated storage tank that can maintain the temperature of the inner storage tank and its contents below thresholds that may ignite or rapidly combust the liquids they contain during prolonged exposure to extreme temperatures, in line with the requirements of UL2085 standard, but while reducing the weight and footprint that would otherwise be required for the same storage capacity. Further still, the structural features of the technology described herein may ensure that the tank is strong enough to pass the structural integrity requirements of the UL2085 standard.

While the technology described herein has been illustrated and described in detail in the drawings and foregoing description, such illustration and description are to be considered illustrative or exemplary and not restrictive; the technology described herein is not limited to the disclosed embodiments.

The invention claimed is:

1. An insulated tank for storing flammable and combustible liquid, comprising:

an outer containment tank; and an inner storage tank that defines a reservoir for storing flammable and combustible liquid;

wherein the inner storage tank is received within the outer containment tank such that a space is defined between walls of the inner storage tank and walls of the outer containment tank; and wherein the space contains one or more perlite boards to insulate the inner storage tank.

2. An insulated tank as claimed in claim 1, wherein the inner storage tank is supported within the outer containment tank by at least one perlite board that is positioned on a base wall of the outer containment tank.

3. An insulated tank as claimed in claim 1, wherein the space further contains a concrete aggregate mixture of cement and perlite.

4. An insulated tank as claimed in claim 3, wherein:

the outer containment tank comprises a stiffening arm that extends inwards by a perpendicular extent from an inner surface of a wall of the outer containment tank; and the perpendicular extent is larger than a thickness of the one or more perlite boards, such that a distal end of the stiffening arm to the inner surface protrudes into the concrete aggregate mixture.

5. An insulated tank as claimed in claim 4, wherein the stiffening arm has at least one slot that is filled by the concrete aggregate mixture.

6. An insulated tank as claimed in claim 1, wherein a wall of the inner storage tank has a corrugated structure.

7. An insulated tank as claimed in claim 1, wherein:

the space further contains a concrete aggregate mixture of cement and perlite;

the outer containment tank comprises a stiffening arm that extends inwards by a perpendicular extent from an inner surface of a wall of the outer containment tank;

the perpendicular extent is larger than a thickness of the one or more perlite boards, such that a distal end of the stiffening arm to the inner surface protrudes into the concrete aggregate mixture;

a wall of the inner storage tank has a corrugated structure; and the distal end of the stiffening arm is received in a space that is within an indentation of the corrugated structure of the wall of the inner storage tank.

8. An insulated tank as claimed in claim 1, wherein the outer containment tank is shaped to define a substantially cuboidal structure.

9. A method of manufacturing an insulated tank for storing flammable and combustible liquid, comprising:

forming a first tank that defines a reservoir for storing combustible liquid;

forming a second tank that has an open end suitable for receiving the first tank therethrough;

lining an inner surface of the second tank or an outer surface of the first tank with one or more perlite boards;

inserting the first tank into the second tank through the open end of the second tank; and connecting an open end wall to the second tank so as to substantially close the open end of the second tank.

10. A method as claimed in claim 9, further comprising forming the first tank to have one or more corrugated walls.

11. A method as claimed in claim 9, wherein the step of inserting the first tank into the second tank through the open end of the second tank begins after the step of lining an inner surface of the second tank or an outer surface of the first tank with one or more perlite boards has been completed.

12. A method as claimed in claim 9, comprising:

lining an inner surface of a base wall of the second tank with one or more perlite boards; and positioning the first tank on the one or more perlite boards that line the inner surface of the base wall of the second tank, such that the first tank is supported within the second tank by the one or more perlite boards.

13. A method as claimed in claim 9, further comprising, after connecting an open end wall to the second tank so as to substantially close the open end of the second tank:

inserting an aqueous mixture of cement and perlite into a space between the first and second tank; and allowing the aqueous mixture of cement and perlite to harden and cure to form a concrete aggregate mixture of cement and perlite.

14. A method as claimed in claim 13, wherein forming the second tank comprises affixing a stiffening arm to the inner surface of the second tank, the stiffening arm extending inwards from the inner surface by a perpendicular extent that is larger than a thickness of the one or more perlite boards.

15. A method as claimed in claim 14, wherein the first tank has one or more corrugated walls and a distal end of the stiffening arm from the inner surface of the second tank is received in a space that is within an indentation of the one or more corrugated walls of the first tank.

16. A method as claimed in claim 14, wherein the stiffening arm has one or more slots through which a flow of the aqueous mixture of cement and perlite is received when inserting the aqueous mixture of cement and perlite into the space between the first and second tank.

* * * * *